United States Patent [19]

Garneau

[11] 4,447,994

[45] May 15, 1984

[54] GUTTER CONSTRUCTION AND METHOD

[76] Inventor: William L. Garneau, 2835 Buick Ave., Pontiac, Mich. 48054

[21] Appl. No.: 266,662

[22] Filed: May 26, 1981

[51] Int. Cl.[3] ..... E04D 13/06

[52] U.S. Cl. ..... 52/11; 52/12; 52/95

[58] Field of Search ..... 52/11, 12

[56] References Cited

U.S. PATENT DOCUMENTS

| | | | |
|---|---|---|---|
| 189,431 | 4/1877 | Creighton | 52/11 |
| 453,948 | 6/1891 | Smith et al. | 52/12 |
| 846,238 | 3/1907 | O'Dowd | 52/11 |
| 956,372 | 4/1910 | Kreutzberg | 52/12 |
| 1,005,885 | 10/1911 | Ross et al. | 52/11 |
| 2,209,741 | 7/1940 | Sullivan et al. | 52/11 |
| 2,672,832 | 3/1954 | Goetz | 52/11 |
| 2,873,700 | 2/1959 | Heier | 52/12 |
| 2,935,954 | 5/1960 | Matthews et al. | 52/12 |
| 2,948,083 | 8/1960 | Steele | 52/12 |
| 3,344,561 | 10/1967 | Anderson | 52/11 |
| 4,254,595 | 3/1981 | Crosslen | 52/11 |
| 4,286,418 | 9/1981 | Snyder | 52/11 |
| 4,308,696 | 1/1982 | Schroeder | 52/11 |

*Primary Examiner*—John E. Murtagh
*Assistant Examiner*—Michael Safavi

[57] ABSTRACT

An improvement in the combination of a sloped shingle or other roof and a gutter disposed adjacent to and below the lower edge of the roof, the improvement comprising generally a method and means of preventing the destructive effects of wintertime gutter icing and the resulting retention of water on the roof, and comprising more specifically, and in a preferred embodiment, a sheet metal or other thin strip gutter cover means adapted for insertion of one edge thereof under the roof shingles, with the remainder of the cover extending the sloped roof to the outer edge of the gutter, thus effectively eliminating the gutter and gutter function so that water and snow cannot enter the gutter, the gutter cover having means for connecting adjacent gutter cover sections and removably securing the cover to the gutter.

3 Claims, 11 Drawing Figures

GUTTER CONSTRUCTION AND METHOD

BRIEF SUMMARY OF THE INVENTION

This invention relates generally to roof gutters, and more particularly to gutter cover means and a method for at times rendering the gutter incapable of receiving water draining from the roof and preventing debris from entering the gutter.

It is common, in fact almost a universal building practice, to provide gutters and downspouts for residential and other buildings, the main purpose of which is to catch water draining from the roof and to direct it to some desired area. That is, the gutter prevents such water from running directly off the roof edge and onto the ground, which could damage landscaping, such as shrubbery and flowers, get house occupants wet at porches and sidewalks and the like.

While gutters have satisfactorily performed the function of collecting and directing roof water, there have been and are some problems with the use of gutters, particularly in northern climates.

The most common residential building roof comprises asbestos or other shingles nailed on a plywood or other sheathing, which is nailed to the rafters that usually extend beyond the building walls to provide an overhang.

A main problem with gutters is the formation of ice therein in the wintertime. Such a problem is related in a recent actual newspaper "Hotline" item reading, "Q. Can anyone help me? My house has an overhang and aluminum windows. When there is snow and ice on the roof and when it starts to melt, it leaks where the overhang meets the roof, and it comes through the top of the windows. This causes a lot of frost around the window. This is ruining my walls. Could someone help me find out what to do about it?"

What actually happens is that alternate freezing and melting atmospheric conditions, as well as the melting of snow on the roof caused by roof heat loss, causes water to drain off the roof and into the gutters, where it freezes when the temperature drops to freezing temperature. This ice buildup eventually results in an ice dam, which, like any dam, causes a water buildup on the next thaw, in the event of rain, etc.

Since the water can no longer drain off the roof, into the gutter and out the downspout, it builds up beyond the ice dam, flows under the shingles and then leaks through the sheathing wherever there is a leak path.

Because its volume increases when water freezes, repeated freezing of water under the shingles tends to loosen them and shorten roof life.

Also, such a water leak wets the thermal insulation and reduces its insulating properties. Further, the water leaks down the inside or outside walls, leaving water stains and deteriorating the building materials, such as wood framing, plaster, drywall, wallpaper, etc. In fact, ice also forms between the gutter and the facia board to which it is attached, and the expansion thereof and the substantial weight of the ice loosens the gutter mountings and damages the gutter.

The damaging results of gutter icing is apparently sufficiently serious to warrant use of electrical gutter heaters, to prevent the ice dam formation, which are obviously expensive to operate, especially in these days of high energy cost.

Accordingly, a main object of the invention is to provide a relatively inexpensive, water-impervious gutter cover means adapted to prevent water draining off the roof from entering the gutter. In effect, the gutter cover contemplated by the invention extends over the roof and beyond the gutter, thus eliminating the gutter and gutter function while the cover is in place, as in the wintertime, and allowing the water to drain over the roof edge and gutter and onto the ground, as if there were no gutter.

Another object of the invention is to provide such gutter cover means that can be easily and quickly installed, as by inserting one edge thereof between the roof shingles and the roof sheathing, with the remainder of the cover extending over the gutter to the outer edge thereof, so that water drains over the cover and not into the gutter.

Other objects of the invention are to provide other gutter cover elements, such as:

a. inside-mitre and outside-mitre gutter elements;
b. means, such as a clip, for securing the cover means to the outer edge of the gutter;
c. means, such as a connector, for securing together adjacent ends of gutter cover sections;
d. means for accommodating substantial one-way gutter drop;
e. means for directing water away from certain locations such as building entrances.

Use of the gutter cover means contemplated by the invention, which can be easily installed in the fall and removed in the spring, also prevents leaves and other debris from filling the gutters. There are, of course, gutter screens for this purpose. However, being screens, they have openings to allow water to pass therethrough (not impervious to water) and cannot serve as gutter cover means that eliminates the gutter function.

These and other objects and advantages of the invention will become more apparent upon reference to the following specification and the appended drawings.

DETAILED DESCRIPTION

Figure 1:
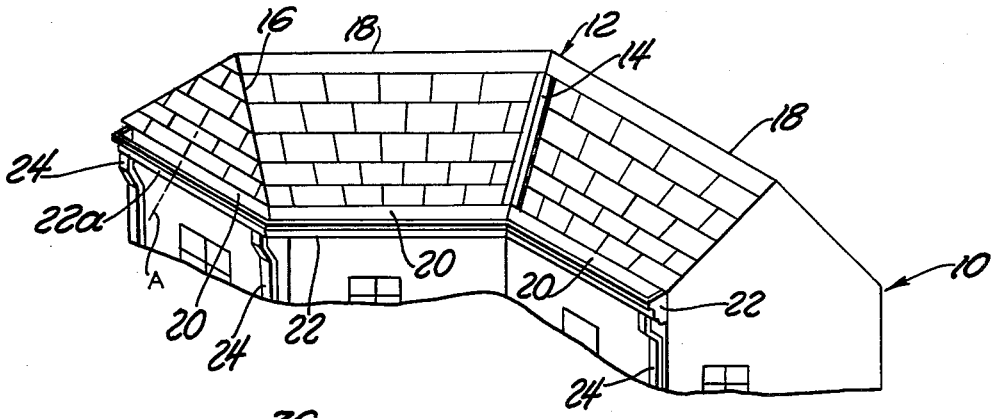
FIG. 1 is a perspective view of a typical roof portion of a building without a gutter cover means installed.

Reference is now made to the drawings, which are for purposes of illustration only, and wherein like elements are identified by the same reference numerals.

Referring first to FIG. 1, a residential or other building 10 is formed with a sloped roof 12, which may have inner-mitre and outer-mitre portions 14 and 16, a peak 18 and outer lower peripheral edges 20. The roof 12 is provided with a gutter 22 secured under and adjacent the edges 20, the structure and function of the gutter being well known.

Figure 2:
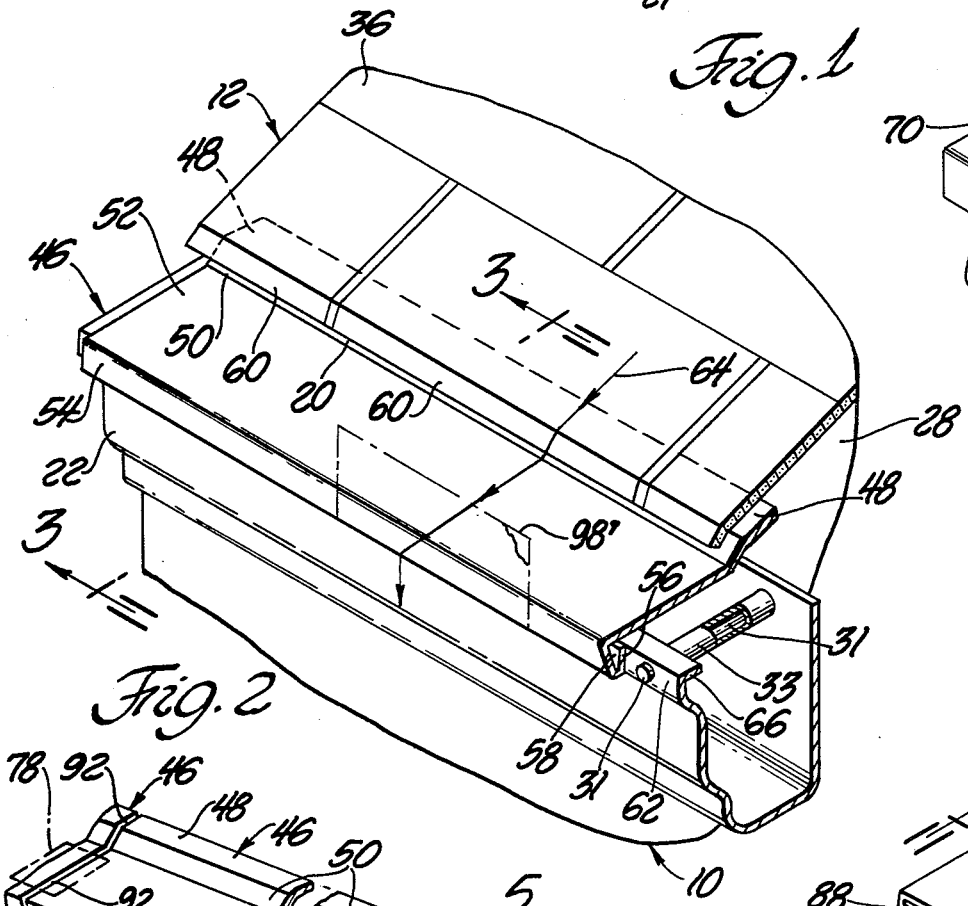
FIG. 2 is an enlarged perspective view, with portions thereof cut away and in cross section, of a typical roof and gutter combination having gutter cover means such as that contemplated by the invention.
Figure 3:
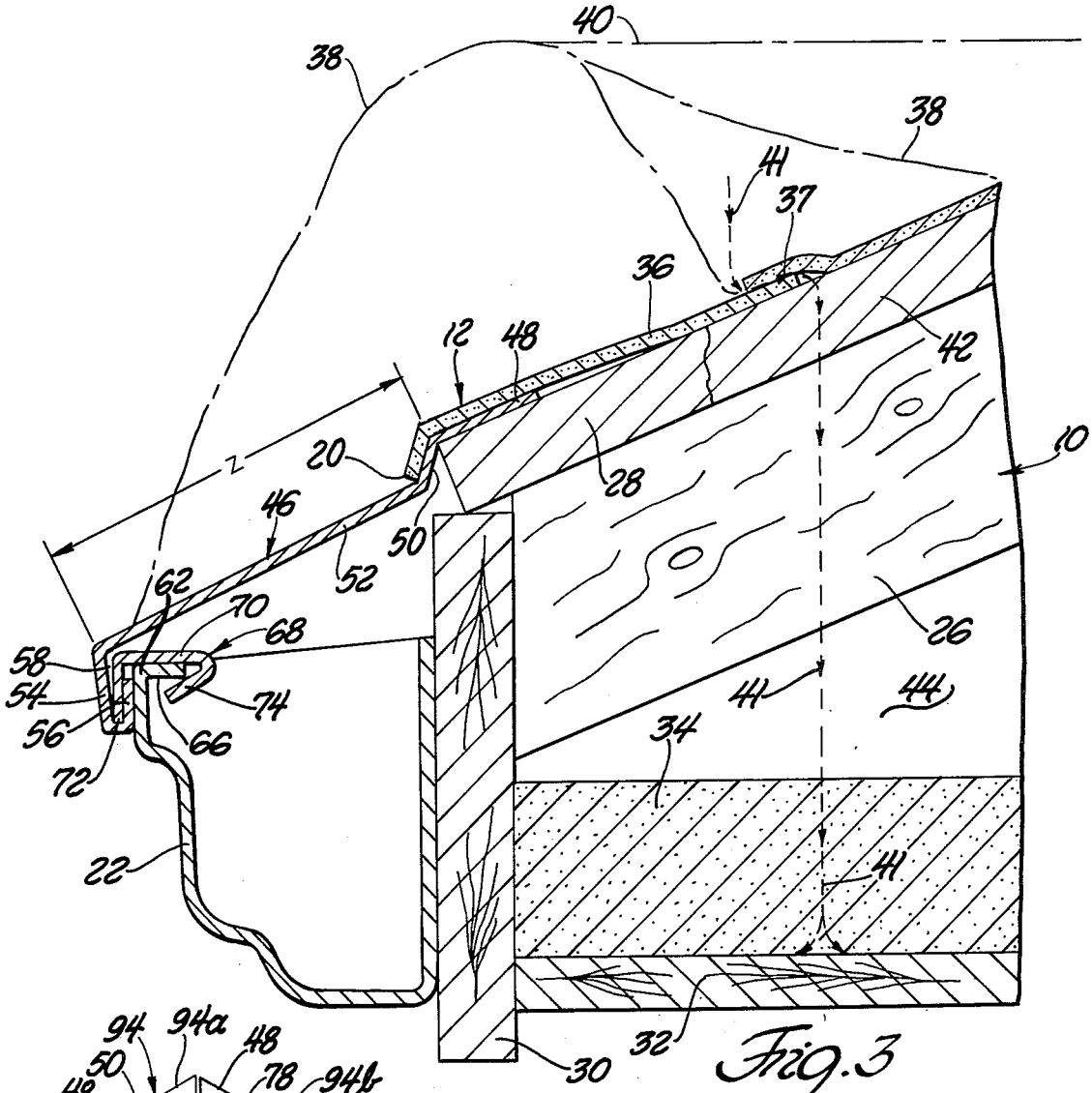
FIG. 3 is a further enlarged cross-sectional view taken on the plane of line 3—3 of FIG. 2, looking in the direction of the arrows.

FIGS. 2 and 3 illustrate additional roof detail, such as the roof rafters 26, the plywood or other roof sheathing 28, the facia board 30 secured to the rafter ends, the overhang ceiling 32, ceiling thermal insulation 34 extending into the overhang, asbestos or other roof shingles 36 and gutter 22, which is usually secured to facia board 30 by gutter spikes 31 passing through spaced gutter ferrules 33.

The roof and gutter structures referred to above are so well known in the prior art that further description thereof is deemed not necessary. Water from rain and melting ice and snow normally drains down the sloped roof and into the gutters 22 and the downspouts 24, as is readily apparent from FIG. 1.

As stated, the invention contemplates an easily assembled and removable gutter cover to substantially prevent entry of water and snow into the gutter during the winter, when ice buildup can occur in the gutter, as shown by broken lines 38 of FIG. 3, to create a continuous ice ridge or dam that can cause and retain a water level 40 on the roof. As represented by dotted line 41, in FIG. 3, this water can leak under the shingles 36, at the overlap joint 37, through any crevices such as the space between the butted ends of adjacent pieces of plywood sheathing 28 and then either into the overhang area 44 or onto the insulation 34 or the room ceilings (not shown), down through window or door headers and the like and then down the walls and onto the floor, as stated in the above-quoted Hotline item.

Obviously, the cost of repairing the serious damage that can be caused by such leakage of roof water can be substantial, and anything that can be done to prevent it is worthwhile.

The general gutter cover structure contemplated by the invention is shown in FIGS. 2–4, FIGS. 4 and 5 illustrating a gutter cover section, per se, and FIGS. 2 and 3 illustrating a gutter cover assembled on the roof and gutter.

Figure 4:
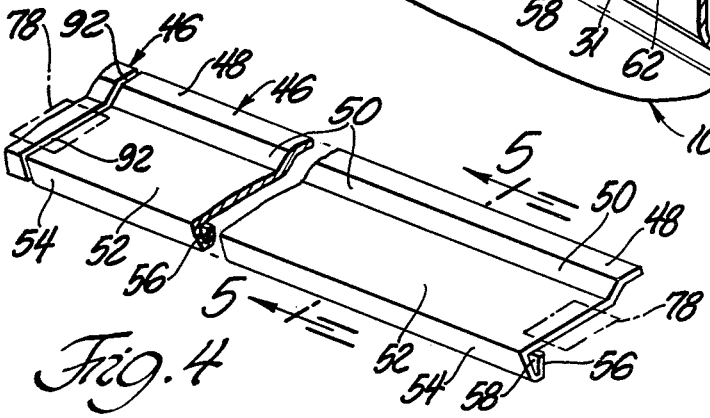
FIG. 4 is a perspective view of a section of the gutter cover shown in FIGS. 2 and 3.
Figure 5:
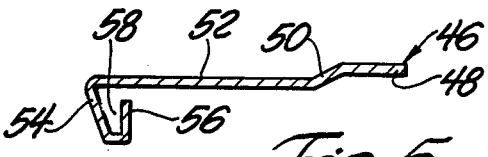
FIG. 5 is an enlarged cross-sectional view taken on the plane of line 5—5 of FIG. 4, looking in the direction of the arrows.

Referring first to FIGS. 4 and 5, the gutter cover section 46 comprises a strip of thin sheet metal, preferably of the same material as the gutter material, such as galvanized steel or aluminum. Section 46 may be of any desired length and can be cut to fit during installation. The section 46 is formed by bending a sheet metal strip to provide edge portion 48, intermediate angular portion 50, main gutter cover portion 52 and a downwardly-turned flange 54 at the edge opposite edge 48 thereof, the flange 54 having a return bend portion 56 providing a recess 58, for a purpose to be explained.

Alternatively, the cover 46 may be formed from some other suitable material, such as a durable molded plastic, for example. Of course, a non-metallic cover will not result in galvanic action corrosion with a metal gutter.

As shown in FIGS. 2 and 3, the gutter cover 46 is assembled on the roof gutter 22 by inserting the edge portion 48 under the shingles at the lower edge 20 of the roof, the angular portion 50 accommodating the portion 60 of the shingles that overhangs the sheath 28, with the portion 52 covering the open gutter 22 and the flange 54 extending downwardly over the gutter and with the return bent portion 56 engaging the top outer edge 62 of the gutter.

It will thus be seen from FIGS. 2 and 3 that the gutter cover 46 eliminates the gutter and its function and, in effect, extends the roof to the outer edge 62 of the gutter. The result is that water from rain or melting snow as represented by the arrow line 64 of FIG. 2 drains over, rather than into, the gutter, and no ice dam 38 builds up.

For strength, the outer edge 62 of the gutter 22 includes an inturned flange 66, which, together with the recess 58, provides means by which a clip 68 (FIGS. 3 and 8) may be employed to prevent disengagement of the cover flange 54 and gutter outer edge 62 and ultimate dislodging of the gutter cover from the roof.

Figure 8:
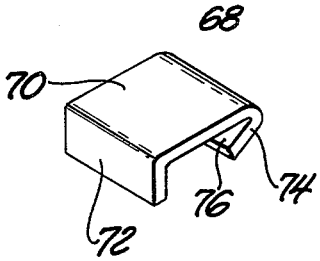
FIG. 8 is an enlarged perspective view of a clip for securing the gutter cover to the gutter.

Referring to FIG. 8, the clip 68 may comprise a relatively short strip of thin sheet metal formed by bending to provide an intermediate portion 70 having a downturned flange 72 at one side and a downwardly and inwardly-turned flange 74 at the other side. As seen in FIG. 3, the flange 72 is adapted, by thickness and width, to be received in the recess 58 between the outer edge 54 and return-bent portion 56 of cover 46, and the intermediate portion 70 is sufficiently wide so that the recess 76 formed between the flange 74 and intermediate portion 70 can receive the inturned flange 66 of the gutter.

The clip 68 can be easily assembled, as explained above, when cover sections 46 are applied to the gutter 22. For example, the clips can be applied to the gutter cover section 46 and then snapped over the in-turned gutter flange 66, there being adequate play in the clip assembly for that purpose. The function of the clips, which are also slidable along the gutter-cover assembly, is to anchor the cover edge 54 to the gutter edge 62, and to thus prevent the cover 46 from sliding off the roof. Ideally, there would be a clip 68 at least at each end of a gutter cover section 46, but such a clip can be located at any desired portion of the cover.

Of course, the clip 68 can be formed from other suitable materials, such as molded plastic. Further, while the specific clip 68 is shown and described, it is of course possible that some other retaining means can be employed to prevent the gutter cover from becoming dislodged from the gutter.

Another fastening means preferably employed in assembling the gutter cover is a connector 78, the function of which is to maintain the butting ends of adjacent gutter cover sections in alignment. Also, the connectors 78 cover the crevices between the ends of adjacent cover sections 46 (represented by line 90 of FIG. 7), to prevent water from entering the gutter through such crevices.

As in the case of the clip 68, the connector may be formed in any desired manner, such as from molded plastic or rubber, or the like.

Also, as stated previously, the gutter cover 46, like the gutters 22, may be formed in relatively long sections and cut to size at the building site.

Figure 6:
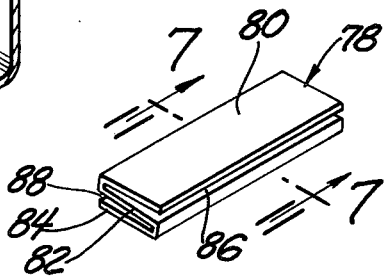
FIG. 6 is an enlarged perspective view of a gutter cover section connector.
Figure 7:
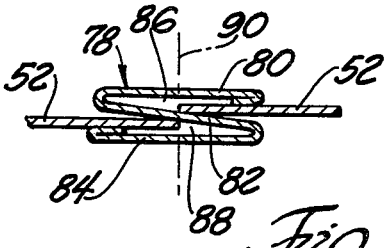
FIG. 7 is a further enlarged cross-sectional view taken on the plane of line 7—7 of FIG. 6, looking in the direction of the arrows.

As shown in FIGS. 6 and 7, the connector 78 may comprise a sheet of relatively thin sheet metal bent in opposite directions along parallel lines to provide upper, intermediate and lower portions 80, 82 and 84, respectively, connected in a manner to provide oppositely-opening recesses 86 and 88. As shown in FIGS. 4 and 7, each of the recesses 86 and 88 is adapted to receive one end of a gutter cover section 46, in abutting relation at a vertical plane through the centerline 90. It is thus apparent that the connector covers the crevices 92 between the ends of adjacent sections 46.

As shown in FIG. 1, the roof 12 is formed with an inner-mitre valley 14 and an outer-mitre valley 16, and the continuous gutter 22 has corresponding inner-mitre and outer-mitre portions. Accordingly, the gutter cover system requires inner-mitre and outer-mitre portions 94 and 96, as shown in FIGS. 9 and 10, respectively.

Figure 9:
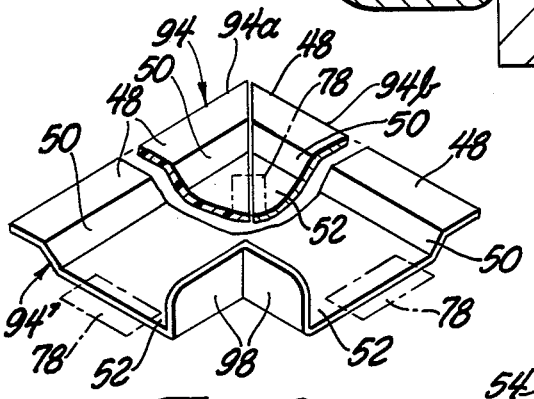
FIG. 9 is a perspective view of an inside-mitre corner gutter cover section.
Figure 10:
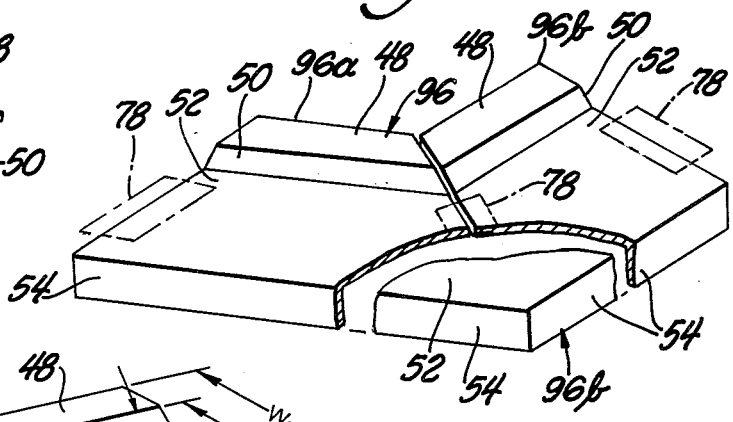
FIG. 10 is a perspective view of an outside-mitre corner gutter cover section.

In FIG. 9, the inner-mitre gutter cover element 94 is broken-away to illustrate alternative constructions thereof. The upper broken-away portion illustrates separate half-elements **94*a* and 94*b* that can be connected by a connector element 78 such as that already described above. It will be noted that the elements 94*a* and 94*b* have the same edge, angular and main cover portions as the portions 48, 50 and 52 of gutter cover sections 46**.

The lower broken-away portion 94' of FIG. 9 illustrates a one-piece inner-mitre element also having the same edge, angular and main cover portions 48, 50 and 52, respectively, as the upper broken-away portion. Additionally, both the upper and the lower broken-away portions are preferably formed with upwardly-turned walls 98 for dividing water draining down the inner-mitre valley 14, in which case there may be no downwardly-turned flange 54.

As stated, where the element 94 is of single-piece construction, connectors 78 may be employed to connect the same to the cover portions 46 at each end thereof. Since the elements 94 are relatively short, connectors 78 are sufficient to retain the same on the gutter 22, clips 68 and not being necessary. That is, clips on the cover sections 46 and the connectors 78 are adequate to secure the element 94.

The outer-mitre gutter cover element 96 of FIG. 10 is also broken away into upper and lower portions, the upper broken-away portion being of two-piece construction, including halves **96*a* and 96*b*, and the lower broken-away portion 96'** being of one-piece construction.

As in the case of inner-mitre element 94 of FIG. 9, the outer-mitre element 96 of FIG. 10 includes the edge, angular and main cover portions of identical dimension and configuration as portions 48, 50 and 52 of cover section 46 for insertion under the roof shingles, accommodation of the shingle overhang 60 and covering the gutter, respectively. Additionally, since there is no valley at the outer-mitre roof portion, there is no need for the water-dividing upwardly-bent walls 98 of elements 94, and the downwardly-turned flange 54 can be provided, so that clips 68 may be employed, if desired.

Being relatively small, the elements 96, like elements 94, may not require clips 68, and they may be secured to each other, in the case of two-piece construction, and to the gutter cover sections 46 extending from the ends thereof by connectors 78. However, if necessary, a flange 54 may be formed adjacent walls 98 to receive a clip 68.

It is apparent that up-turned walls 98' equivalent to walls 98 (see FIG. 2) may be provided anywhere along a gutter cover section 48, to prevent water run-off above building entrances or other areas where desired. For example, the material of flange 54 can be bent upwardly, rather than forming the down-turned flange.

Figure 11:
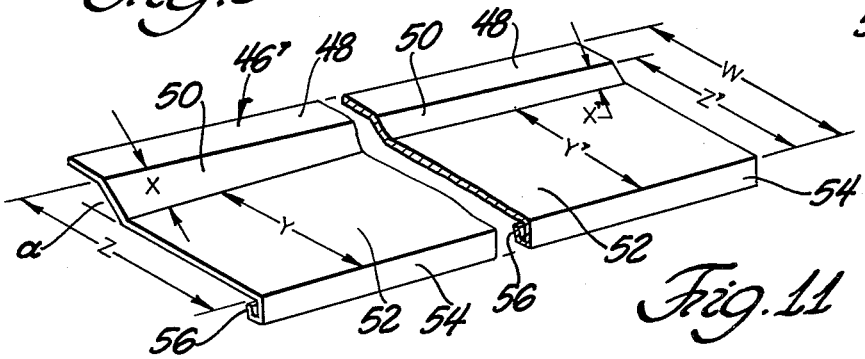
FIG. 11 is a perspecitve view of a gutter cover section that accommodates substantial gutter drop.

Reference is now made to FIGS. 1 and 11. The usual instructions by gutter manufacturers is that gutter installation should provide a drop of 1" in 20' of gutter length to provide adequate drainage to the downspout. Further, in the case of a 40' gutter span or length, for example, it is recommended that the center of the span be the high point and that the gutter be sloped 1" in each direction from the center high point.

That is, assuming that the gutter **22*a* of FIG. 1 were 40' long, then the vertical distance from the lower roof edge 20 to the top of the gutter would be 1" less at the gutter center A than it would be at the ends of gutter span 22*a*. This would also result in a slightly greater diagonal distance, at the ends of the gutter 22*a*, from the lower edge 20 of the roof to the top outer edge 62 of the gutter, which is substantially the width of the main cover portion 52 of the gutter cover 46. The configuration and dimensions of the gutter cover 46** are sufficient to accommodate such variation in diagonal distance referred to above.

However, it is estimated that a substantial percentage of homes with a 40' gutter span **22*a* require, for whatever reason, a one-way slope, wherein the high point is at one end of the gutter 22*a* and the low point is at the other end thereof. In that case, the gutter would be 2" lower (1" drop in 20') at the low end, and the gutter cover portion 52 would have to be proportionately wider, to accommodate the greater distance between the lower roof edge 20 and the top outer edge 62** of the gutter.

FIG. 11 illustrates such a gutter cover section 46', wherein the widths of the portion 48 and flange 54 and the overall width W are the same as those of the gutter cover section 46. However, varying the widths (X and X', Y and Y') and/or the angle (a) of the angular and main cover portions 50 and 52, results in a greater cover dimension Z' at the low end, as compared to the dimension Z at the high end, to accommodate the different roof edge to gutter edge dimensions. Such gutter cover section configurations can, of course, be varied as needed to accommodate various one-way-slope gutter lengths. Also, right and lef-hand configurations can be provided. Further modifications can be made to accommodate a greater gutter drop, such as 3" in 60'.

SUMMARY OF GUTTER COVER INSTALLATION AND OPERATION

From the above description, the following facts become apparent:

1. Gutter icing, which is caused by freezing of water and wet snow in the gutter and usually occurs several times annually during the winter months in northern climates, and which retains water on the roof, creates a number of serious problems, including deterioration of the roof, walls and even the gutter itself.
2. The seriousness of the problem is exemplified by the use of electrical gutter heaters, for example.
3. The invention provides a unique solution to this problem, since the gutter cover contemplated thereby completely eliminates the gutter where the problem ice dam is otherwise formed.
4. Further, use of the invention keeps the gutters free of wintertime debris, such as windblown tree twigs and the like.

That is, the gutter cover contemplated by the invention, which may be very easily installed in the fall and removed and stored in the spring, eliminates the gutter, and the above-described wintertime gutter problems. Accordingly, it is readily apparent that the invention provides the objects and the advantages set forth above.

The gutter cover structure described is intended as representative only, and modifications thereof are possible within the scope of the invention. Accordingly, no limitations are intended, except as recited in the appended claims.

What I claim as my invention is:

1. A gutter cover, comprising a relatively thin strip of metal, plastic or other suitable weather resistant material, said strip having substantially parallel opposite ends and opposite side edges, said cover being formed along one edge thereof so as to provide a portion adapted to be insertable between the shingles and the sheathing at the lower peripheral edge of a roof and so that a portion of said cover strip may slopingly extend from the roof and beyond the outer edge of a gutter secured to the roof so that water draining from the roof is prevented from entering the gutter, said cover being formed to accommodate the fall of the gutter with respect to the horizontally level roof edge that results in a progressively greater slope distance from the roof edge to the outer edge of the gutter from the higher end to the lower end of the gutter.

2. A gutter cover assembly for a building with a sloped roof having roof support means such as rafters sloping downwardly to the lower roof edge at the building outer wall, the support means being covered by a sheath and the sheath being covered by protective means such as rows of shingles in a manner permitting insertion of a metal or other sheet material between the sheathing and the shingles at the lower roof edge, the shingles at the lower roof edge possibly overhanging and being turned downwardly over such edge, and a gutter secured to the building adjacent and below the lower roof edge so as to receive and carry away water draining from the roof, the gutter having a top outer edge spaced from the lower roof edge and being longitudinally sloped from its higher to its lower end to provide a fall causing water to drain to the lower end, the fall resulting in a greater dimension between the lower roof edge and the top outer edge of the gutter at the gutter lower end than at the gutter higher end, said gutter cover assembly comprising a plurality of elongated gutter cover sections, each of said sections having a transverse cross-sectional configuration corresponding to the cross-sectional configuration of the roof lower edge/gutter structure so that one side edge is adapted to be inserted between the sheathing and the shingles at the lower roof edge without disturbing any downturned overhanging shingle, the opposite side edge of each of said sections having a configuration including a flange with a return bend recess, said flange being adapted to overlay and engage the top outer edge of the gutter, said cover sections when assembled end-to-end continuing the slope of the roof as if there were no gutter, a one-piece clip removably securing said flanged edge of each of said sections to the top outer edge of the gutter, said clip being disposed entirely under said cover section and having a portion thereof engaged in said return bend recess, said clip being free of any other separate securing means such as screws, the adjacent ends of said elongated sections being secured to each other by a one-piece flattened Z-shape connector means, each of said connectors being likewise free of any other separate securing means and comprising a body formed so as to provide relatively thin top, intermediate and bottom portions, said top and bottom portions extending from opposite sides of said intermediate portion, whereby said body is formed with a pair of wedge-shaped recesses open from opposite sides of said body, each of said recesses being adapted to wedgingly receive the end of one of said end-to-end gutter sections, said wedge recesses enhancing the connecting force and efficiency of said connector, said connector covering the crevice between the abutting ends of said sections to prevent water from entering the gutter, said cover sections having portions between said sides thereof formed with a substantially uniform taper so as to accommodate the increasing roof edge-to-gutter outer edge dimensions resulting from gutter slope, said cover assembly including inner-mitre and outer-mitre cover sections for covering inner and outer-mitre gutter portions, said mitre cover sections being adapted to be secured to said elongated cover sections by said Z-shaped connector means, said assembly, in any particular installation, including said elongated cover sections, mitre sections, clip and connector means, as required.

3. An assembly such as that recited in claim 2, wherein said elongated sections are formed with upturned flanges at locations over doorways to prevent water drain over the same.

* * * * *